United States Patent [19]

Clayton

[11] Patent Number: 4,493,097

[45] Date of Patent: Jan. 8, 1985

[54] ELECTRON GUN ASSEMBLY

[75] Inventor: Robert H. Clayton, Ridgefield, Conn.

[73] Assignee: The Perkin-Elmer Corporation, Norwalk, Conn.

[21] Appl. No.: 412,461

[22] Filed: Aug. 30, 1982

[51] Int. Cl.[3] ..... H01J 3/00

[52] U.S. Cl. ..... 378/137; 378/134; 250/398

[58] Field of Search ..... 378/137, 134, 140; 250/398

[56] References Cited

U.S. PATENT DOCUMENTS

| | | | |
|---|---|---|---|
| 2,482,275 | 9/1949 | Horsley | 378/137 |
| 2,569,872 | 10/1951 | Skeham et al. | 378/137 |
| 4,017,757 | 4/1977 | DeCon | 378/134 |
| 4,215,192 | 7/1980 | Buckley | 378/34 |

*Primary Examiner*—Bruce C. Anderson

*Attorney, Agent, or Firm*—Thomas P. Murphy; Edwin T. Grimes; Francis L. Masselle

[57] ABSTRACT

This invention relates to an electron gun assembly for use, for example, in x-ray lithography, which includes an electron emitter assembly, beam forming elements disposed adjacent the electron emitter assembly, a target plane disposed in spaced relationship with respect to the electron emitter assembly, a deflector disposed adjacent the path of the electrons emitted from the electron emitter assembly, a pseudoanode mounted in spaced relationship with respect to the deflector and to the electron emitter assembly and to the target plane, said electron emitter assembly being interposed between the pseudoanode and the target plane.

12 Claims, 3 Drawing Figures

ELECTRON GUN ASSEMBLY

BACKGROUND OF THE INVENTION

This invention relates to x-ray lithography, and more particularly to an electron gun assembly suitable for use therewith.

Heretofore, various types of lithography have been used in the manufacture of integrated semiconductor circuits. Photoresist was deposited on the surface of a semiconductor wafer and then the wafer was optically exposed. However, as a result of the requirement for miniaturization, lithography has progressed toward shorter and shorter wavelengths, which are necessary to provide good resolution and small feature size. X-ray lithography has been proposed as a solution to the resolution problem because it has particularly short wavelengths. In such lithography, a mask, having the desired pattern thereon, is interposed between the source of radiation and the semiconductor substrate with the resist on which the pattern is to be exposed.

A high power density electron source is needed for soft x-ray generation such as, for example, 20 kW at 10 kV into a 1 mm spot diameter, which preferably is variable. Heretofore, diodes of the preferred annular form did not provide enough current at low target potential. Triodes have been considered, but they suffer from complexity of fabrication, more complicated and better regulated power supplies, overheating of the intermediate anode by backscattered electrons, and difficulties in cooling the electrodes and supporting insulators.

It is an object of the present invention to provide a new and improved electron gun assembly, which is particularly adapted, among other possible uses, for use in x-ray lithography, which overcomes or at least mitigates a number of the above-identified problems of the prior art gun assemblies, and which has high diode perveance.

SUMMARY OF THE INVENTION

Briefly, my invention contemplates, in one form thereof, the provision of a new and improved electron gun assembly for use in x-ray lithography which comprises, in combination, an electron emitter assembly, beam forming means disposed adjacent the electron emitter assembly, a target plane disposed in spaced relationship with respect to the electron emitter assembly. In addition, according to the invention, deflector means are disposed adjacent the path of the electrons emitted from the electron emitter assembly, a pseudoanode mounted in spaced relationship with respect to the deflector means, and to said electron emitter assembly and to said target plane, the electron emitter assembly being interposed between the pseudoanode and the target plane.

According to one aspect of the invention, the electron emitter assembly, beam forming means and deflector means are all maintained substantially at a first preselected voltage, and said target plane and pseudoanode are maintained substantially at a second preselected voltage.

According to another aspect of the invention, a circular membrane shield is mounted adjacent the deflector means for intercepting electron backscatter and evaporants from the target plane.

According to still another aspect of the invention, an annular perforated plate is disposed adjacent the target plane to obscure the focus spot from the line-of-sight of the electron emitter assembly.

There has thus been outlined rather broadly the more important features of the invention in order that the detailed description thereof that follows may be better understood, and in order that the present contribution to the art may be better appreciated. There are, of course, additional features of the invention which will be described more fully hereinafter. Those skilled in the art will appreciate that the conception on which this disclosure is based may readily be utilized as the basis for other systems for carrying out the several purposes of the invention. It is important, therefore, that this disclosure be regarded as including such equivalent systems as do not depart from the spirit or scope of the invention.

Several embodiments of the invention have been chosen for purposes of illustration and description and are shown in the accompanying drawings, forming a part of the specification.

DETAILED DESCRIPTION OF THE INVENTION

Figure 1:
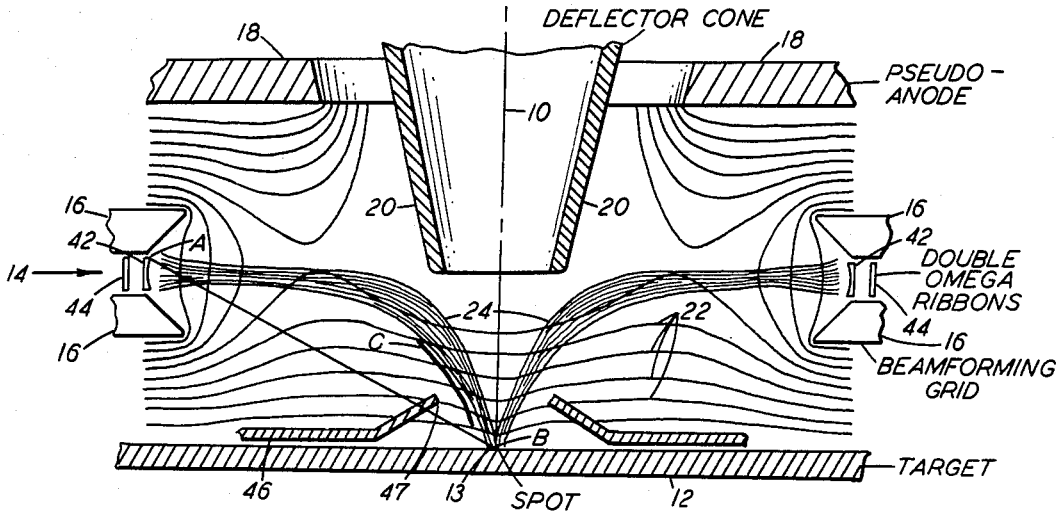
FIG. 1 is a schematic vertical sectional view of an electron gun assembly showing the path of the electron beam and the electrical fields.

As seen in FIG. 1, the electron gun assembly, according to the invention, has a vertical or system axis indicated at 10. The horizontal axis is the true anode or target plane 12, having a focal spot 13 at the vertical axis 10. An annular cathode or electron emitter assembly 14 has its center substantially on the system axis 10. Annular beam forming plates or grid 16 encompass the cathode 14 in a sandwich-like manner, and an additive annular passage or pseudoanode 18 is mounted in spaced relationship with its center located substantially on the system axis. A deflector cone 20 is centrally disposed about the axis 10 and the walls thereof are tapered outwardly in the direction away from said target focal spot 13. By varying the potential of the deflector cone either to the plus or minus side of the beam former assembly 16 potential, the focused spot 13 may be enlarged into an annulus whose diameter is adjustable as desired. Still referring to FIG. 1, equipotential surfaces are indicated at 22, and the electron trajectories are indicated at 24.

In operation, electrons are freed from the cathode surface 14 by thermionic excitation and are drawn away from the surface by the attractive electrostatic force generated by both the anode 12 and the pseudoanode 18. Although initially convergent, the electron bundle 24 soon reaches a minimum diameter where coulomb forces begin to diverge the bundle. Subsequently, as it approaches the deflector cone 20, the bundle 24 experiences a focusing action concurrent with a deflection toward the true anode or target 12, which it intercepts at the focus spot 13 at the axis 10 of the electron gun. In one example of the invention, the total focal spot diameter is somewhat less than one millimeter when the electrodes 14, 16 and 20 are at −10 KV relative to the anodes 12 and 18. The current flow under these conditions is about 2.38 amperes. The preveance, then, is 2.38 micropervs.

Figure 3:
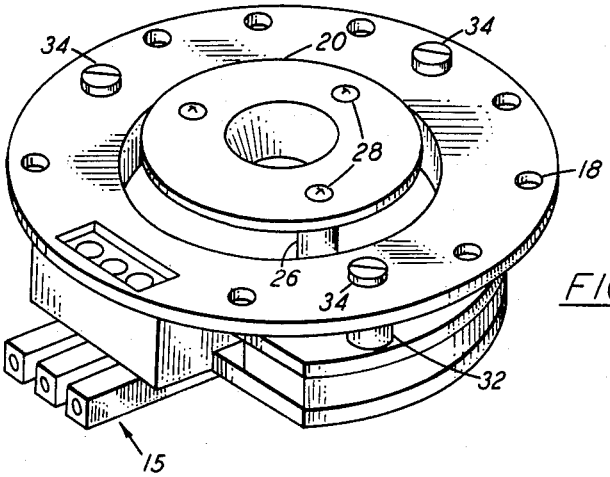
FIG. 3 is a perspective view of the electron gun assembly of FIG. 2.
Figure 2:
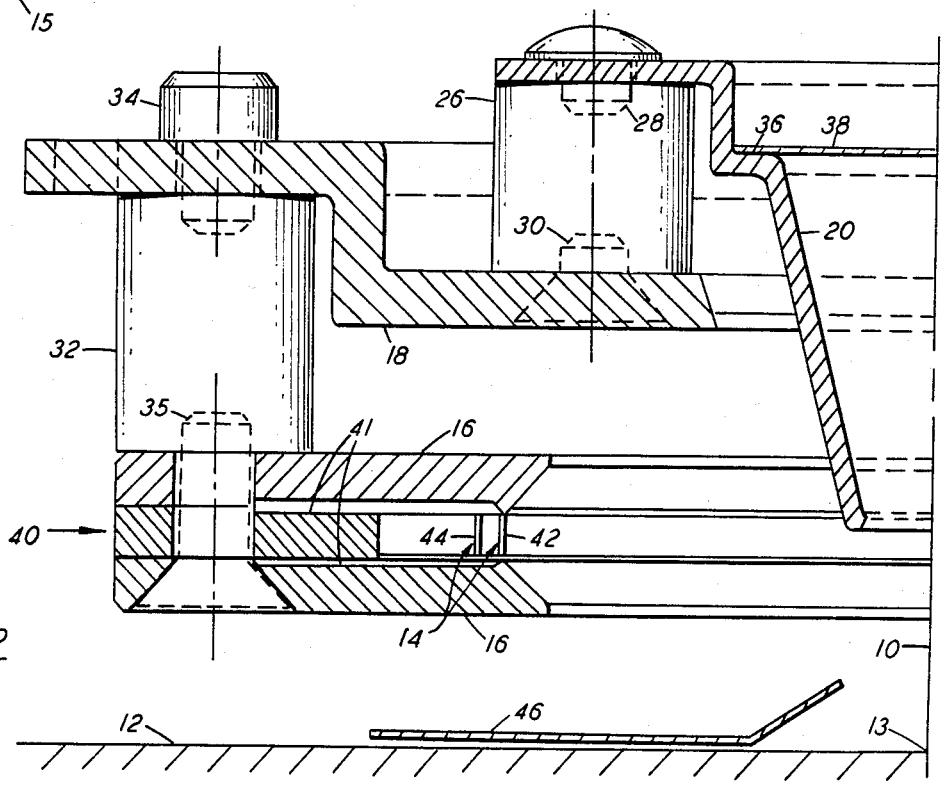
FIG. 2 is an enlarged fragmentary vertical sectional view of an electron gun assembly constructed according to the invention.

As best seen in FIG. 2, a plurality of circumferentially spaced steatite insulators 26 serve to hold the deflector cone 20 and the pseudoanode 18 in fixed space and electrically isolated relationship with respect to each other. Machine screws 28 connect the deflector cone 20 to the insulator at one end and machine screws 30 connect the pseudoanode 18 at the other end. A plurality of circumferentially spaced steatite insulators 32 serve to hold the pseudoanode 18 and the beam forming plates 16 in fixed spaced and electrically insulated relationship with respect to each other. Machine screws 34 connect the pseudoanode 18 to one end of the insulator 32 and machine screws 35 connect the forming plates 16 to the other end of the insulators. Still referring in particular to FIG. 2, the conic deflection cone 20 is provided with a ledge or shoulder 36 for receiving and supporting a mesh or thin circular membrane shield 38, which intercepts electron backscatter and evaporants from the focal spot 13. The beam forming plates 16 are formed with a slot and metal spacer therebetween as indicated at 40 in FIG. 2, which permits easy insertion and exchange of the electron emitter assembly into previously aligned electrodes. Two or more radially deposed grooves 41 are provided in the inner surfaces of the electrodes 16 to contain thin ceramic rods, said rods serving to prevent contact between ribbons 42, 44 and electrodes 16 owing to shock, vibration or sag of the ribbons 42, 44. The thermionic emitter assembly is provided with accessible electrical terminals indicated at 15 in FIG. 3. Any suitable electron source may be employed such as, for example, a resistively heated double ribbon shaped emitter which, as best seen in FIG. 2, includes an inner hoop-like ribbon loop 42 fabricated from thoriated tungsten and a series connected outer hoop-like ribbon loop 44 fabricated from tungsten. Tantalum may also be suitable for some installations. As another example, a machined matrix cathode may be used as the electron source, which employs a coiled wire embedded within its machined body for indirect heating. Such a cathode may be fabricated from any suitable material, such as, for example, barium/tungsten.

For several practical reasons having to do with high voltage safety, x-ray source power supplies are normally operated with the positive end grounded. This means that the pseudo anode 18, operated at ground, may be heat-sinked directly, or through electrically conducting liquid coolant circuits, to the world outside its vacuum environment. This feature makes the assembly immune to thermal damage from the profuse high energy backscattered electrons associated with bombarded large atomic member elements such as, for example, tungsten. Fortuitously, any x-rays which may be generated as backscattered primaries bombard the underside of the pseudo anode 18, will be screened by the electrode structure from reaching the mask-wafer set.

There is concern with electron guns due to the behavior of ions which may be generated both by electron collision and by thermal ionization. The largest density of ions and the most energetic ions in an annular electron gun will both occur near the axis because the current density is highest there and so is the hot focal spot, and the space potential is the most positive there. As seen in FIG. 1, virtually all positive ions generated in the beam path from the axis 10 to one-half the cathode radius will be directed by the electric field to the central cone. Here, they will do no damage. Those ions from one-half the cathode radius outwardly are exclusively collision-generated, and have energies of less than 4 KeV in the case of a diode potential of 10 KV. Although they will impact on the cathode and beam-forming electrodes, their numbers and energies are relatively small. It is the positive ion damage of the cathode which causes the greatest damage. Both the ability to handle the thermal dissipation of backscattered electron energy and the partial positive ion protection of the emitter were unexpected benefits of the invention.

It will be appreciated that the diode voltage may be changed as desired, and the power delivered will vary directly as the voltage to the 2.5 power. The upper limit is high voltage arc-over, or target evaporation/melt down.

In some installations, it is desirable to add a perforated plate 46, FIGS. 1 and 2, in or near the anode plane 12 to obscure the focus spot 13 from the line-of-sight of the cathode surface 42, 44. As seen in FIG. 2, the perforated plate 46 has a central aperture 47, the radius of which falls somewhere between maximum and minimum limits. The maximum limit is defined by a line connecting the emitter top A to the distal portion of the focal spot B. The minimum limit is defined by the electron beam lower envelope C. The perforated plate 46 may assume any suitable shape such as, for example, a flat plate, a dished plate, etc. This passive element serves to avoid cross-contamination by evaporants from either the target or the cathode.

It will thus be seen that the present invention does indeed provide a new and improved electron gun assembly for use in x-ray lithography, which effectively meets the objects specified hereinbefore.

Although certain particular embodiments of the invention are herein disclosed for purposes of explanation, further modification thereof, after study of this specification, will be apparent to those skilled in the art to which the invention pertains.

Reference should accordingly be had to the appended claims in determining the scope of the invention.

What is claimed is:

1. An electron gun assembly, having a system axis, for use in x-ray lithography comprising, in combination, an annular electron emitter assembly having its center substantially on said system axis, beam forming means encompassing said electron emitter assembly in a sandwich-like manner to form a bundle of electrons directed substantially radially inwardly toward said system axis, an anode target mounted substantially perpendicular to said system axis and in axially spaced relationship in a first direction with respect to the plane of said electron emitter assembly, deflector means having an elongated internal cavity disposed substantially concentrically about said system axis, said deflector means being mounted radially inwardly of said electron emitter assembly and axially near the plane of said electron emitter assembly, an annular pseudoanode mounted perpendicular to the system axis, said pseudoanode being radially outwardly disposed with respect to said deflector means and having its center disposed substantially on said system axis in axially spaced relationship in a direction opposite said first direction with respect to the plane of said electron emitter assembly, whereby electrons freed from said electron emitter assembly are drawn radially inwardly by the attractive electrostatic force generated by both said anode target and said pseudoanode and thereafter said deflector means deflects said electrons in an axial direction toward said anode target.

2. An electron gun assembly according to claim 1 wherein said electron emitter assembly, beam forming means and deflector means are all maintained substantially at a first preselected voltage, and said anode target and pseudoanode are maintained substantially at a second preselected voltage.

3. An electron gun assembly according to claim 1 or claim 2 further comprising a circular membrane shield means mounted adjacent said deflector means for intercepting electron backscatter and evaporants from the anode target.

4. An electron gun assembly according to claim 1 or claim 2 further comprising an annular perforated plate disposed adjacent the anode target to obscure the focus spot from the line-of-sight of the electron emitter assembly.

5. An electron gun assembly, having a system axis, for use in x-ray lithography comprising, in combination, an annular electron emitter assembly disposed perpendicular to and having its center substantially on the system axis, annular beam forming plate means encompassing said electron emitter assembly in a sandwich-like manner and being perpendicular to and having its center substantially on the system axis to form a bundle of electrons directed substantially radially inwardly toward said system axis, an anode target plane mounted substantially perpendicular to the system axis and in axially spaced relationship in a first direction along the system axis with respect to the plane of said electron emitter assembly, a deflector cone having its axis on the system axis and its walls tapered outwardly in the direction away from said target plane, the lower end of said deflector cone being substantially adjacent the plane of said electron emitter assembly, said electron emitter assembly being radially outwardly spaced from said deflector cone, an annular pseudoanode being perpendicular to and having it center substantially on the system axis, said pseudoanode being radially outwardly disposed with respect to said deflector cone and being axially spaced in a direction opposite said first direction along the system axis with respect to the plane of said electron emitter assembly, whereby electrons freed from said electron emitter assembly are drawn radially inwardly by the attractive electrostatic force generated by both said anode target plane and said pseudoanode and thereafter said deflector cone deflects said electrons in an axial direction toward said anode target plane.

6. An electron gun assembly according to claim 5 wherein electrical insulating means are interposed between said deflector cone and said pseudoanode to rigidly connect them one to the other.

7. An electron gun assembly according to claim 5 or 6 wherein electrical insulating means are interposed between said pseudoanode and said electron emitter and the annular beam forming plate means to rigidly connect them one to the other.

8. An electron gun assembly according to claim 5, wherein said electron emitter assembly, beam forming plate means and deflector cone are all maintained substantially at a first preselected voltage, and said target plane and pseudoanode are maintained substantially at a second preselected voltage.

9. An electron gun assembly according to claim 8 wherein said second preselected voltage is ground.

10. An electron gun assembly according to claim 8 wherein the differential between said first preselected voltage and said second preselected voltage is about 10 kV.

11. An electron gun assembly according to claim 5 wherein said deflector cone is formed with an internal shoulder, a circular membrane shield mounted on said shoulder for intercepting electron backscatter and evaporants from the target plane.

12. An electron gun assembly according to claim 5, 8 or 11 further including an annular perforated plate disposed adjacent said target plane to obscure the focus spot from the line-of-sight of the electron emitter assembly.

* * * * *